United States Patent [19]

Shastko

[11] Patent Number: 4,758,303

[45] Date of Patent: Jul. 19, 1988

[54] HAND CRANK LABELING APPARATUS FOR CASSETTES

[75] Inventor: Gordon L. Shastko, Duvall, Wash.

[73] Assignee: Investment Technology, Inc., Bellevue, Wash.

[21] Appl. No.: 901,553

[22] Filed: Aug. 29, 1986

[51] Int. Cl.[4] ..... B44C 3/00

[52] U.S. Cl. ..... 156/542; 156/556; 156/579; 156/DIG. 2; 156/DIG. 27; 156/DIG. 33; 156/DIG. 39; 156/DIG. 42; 156/DIG. 48

[58] Field of Search ..... 156/361, 362, 540, 541, 156/542, 556, 579, DIG. 2, DIG. 27, DIG. 33, DIG. 39, DIG. 49, DIG. 42, DIG. 48

[56] References Cited

U.S. PATENT DOCUMENTS

| | | | |
|---|---|---|---|
| Re. 29,335 | 8/1977 | Gates et al. . | |
| 2,754,994 | 7/1956 | Cole | 156/DIG. 48 |
| 3,238,080 | 3/1966 | Schluter | 56/542 |
| 3,369,952 | 2/1968 | Rieger | 156/541 |
| 3,436,294 | 4/1969 | Marano | 156/542 |
| 3,676,257 | 7/1972 | Ingalls | 156/542 |
| 3,721,601 | 3/1973 | Pituch et al. . | |
| 3,785,909 | 1/1974 | Stageberg . | |
| 3,970,506 | 7/1976 | Kwan | 156/542 |
| 4,082,595 | 4/1978 | Slater | 156/541 |
| 4,104,105 | 8/1978 | Rayfield | 156/DIG. 33 |
| 4,183,779 | 1/1980 | Barber et al. | 156/361 |
| 4,191,607 | 3/1980 | Core | 156/541 |
| 4,325,774 | 4/1982 | Sato . | |
| 4,601,771 | 7/1986 | Wesley | 156/361 |
| 4,636,276 | 1/1987 | Nozaka | 156/361 |
| 4,647,235 | 3/1987 | Sato | 156/542 |

OTHER PUBLICATIONS

Pin-Feed Automatic Cassette Labeler, Investment Technology, Inc., 1940 124th Avenue N.E., Bellevue, WA 98005.

*Primary Examiner*—Jerome Massie, IV

*Attorney, Agent, or Firm*—Hughes, Cassidy & Multer

[57] ABSTRACT

Apparatus for applying labels at selected locations thereon to such diverse artifacts as audio and video cassettes, compact and floppy discs, and envelopes and to a wide variety of other artifacts. The labels are peeled from a continuous backing supplied in roll or fanfold form by pulling the backing around the sharp edge of a peeler which is automatically elevated at an appropriate point in the operating cycle of the apparatus to facilitate the loading and unloading of the artifacts being labeled. A roller cooperates with the peeler in stripping the labels from the backing; and that roller, a second roller, or a brush is used to press the label onto the artifact being labeled. The artifact is supported by an interchangeable insert from a rectilinearly displaceable carriage. The use of interchangeable inserts and vaarious adjustment features allow the apparatus to be employed to: apply labels to different parts of an artifact, apply labels of different sizes and shapes to the artifact, and to apply labels to artifacts of various shapes and sizes. There is a common gear-type drive which effects displacement of the carriage through feed and reset strokes and operates two tractor-type feed mechanisms for the label feedstock; this common drive arrangement insures that the arrival of the artifact to be labeled at the locale of the label peeler and the separation of the label from its backing are so timed that the label is precisely applied to the wanted location on the artifact at the same time that the label is peeled from the backing.

12 Claims, 7 Drawing Sheets

248
249
258

52
204
262
190
198
208
206
196
188
51
41
44
42
46
254
162
172
166
240
244
242
251
250
220
228
216
252
224
218
222
53
230
226
238
236
232
234
249
248
87
160
168
256
246
84
126
122
116
118

HAND CRANK LABELING APPARATUS FOR CASSETTES

TECHNICAL FIELD OF THE INVENTION

The present invention relates to novel, improved apparatus for applying labels to artifacts and, more specifically, to such apparatus which is capable of: applying labels to different parts of the same artifact, of applying labels of different size and shape, and of applying labels to artifacts which are likewise of different sizes and shapes.

One of the presently important uses of my invention involves the application of labels to audio cassettes. For the sake of conciseness and clarity, the principles of the invention will be developed primarily by relating them to that use. This is, however, not intended to limit the protection to which I consider myself entitled as there are many other kinds of artifacts to which labels may equally well be applied by apparatus employing the principles disclosed herein. These include: other types of cassettes such as micro and video cassettes, compact and floppy discs, and envelopes of various shapes and sizes.

BACKGROUND OF THE INVENTION

There are many instances in which there is a need to apply a label of one type or another to a series of like artifacts. For example, there is a recurring need to apply to each of a large number of duplicately recorded cassettes identical labels giving information about the recorded contents.

One state-of-the art machine heretofore developed for that purpose is the Model L-2S Pin Feed Automatic Cassette Labeler marketed by Investment Technology, Inc., Bellevue, Wash.

The L-2S labeler has a number of important attributes. It is durable and reliable; capable of applying labels accurately and consistently; able to handle labels made of a wide variety of materials including paper, plastic, and foil; and easy to operate.

Nevertheless, the L-2S labeler has a number of significant disadvantages. It is heavy and relatively complex and expensive, employing as it does a vacuum system for gripping labels separated from their backing and for subsequently applying those labels to the artifacts being labeled.

Also, the L-2S labeler is less versatile than is desirable in many instances such as those involving a job-shop type of operation with comparatively short runs and succeeding runs of artifacts of different sizes and shapes or in different orientations and/or labels of different shapes and sizes. This is because the L-2S labeler is not equipped to handle artifacts of different sizes or in differing orientations; and it is, similarly, designed to accept label feedstock of only one size. Furthermore, the L-2S labeler can currently be used only to apply labels to audio cassettes as the label indexing mechanism of that apparatus is designed to advance a perforation which only fits audio cassette labels.

SUMMARY OF THE INVENTION

I have now invented, and disclosed herein, labeling apparatus which is like the L-2S labeler described above in that it is durable, reliable, accurate, consistent, and easy to operate. However, the novel apparatus disclosed herein also has the advantages of being much simpler, lighter, and less expensive than the L-2S labeler. Furthermore, it is more versatile in that it can be easily, quickly, and inexpensively set up to apply labels to artifacts of different sizes and shapes and to artifacts which need to be disposed in different orientations so that more than one label can be applied to the artifact and to apply labels of different shapes and sizes as well as labels made from different materials.

Also, in contrast to the L-2S labeler, there is virtually no restriction on the type of artifact to which labels can be applied by the novel labeling apparatus I have invented. Exemplary of the artifacts that the latter is particularly suited to label are: video as well as audio cassettes, compact audio discs, floppy and rigid discs for computer information storage, and both stuffed and empty envelopes as well as other packaged items.

In general, the novel labeling apparatus by which these and other hereinafter discussed advantages of my invention are attained include a base which supports a roll of label feedstock consisting of labels adhesively applied at regular intervals to a continuous backing or is adapted to have a fanfold of similar feedstock located behind it. A tractor-type mechanism feeds the continuous backing from the feedstock support or fanfold to the station where the labels are to be applied to the artifacts being labeled.

At the labeling station, the continuous backing is trained around a knife-edge peeler to separate the labels from the backing. A roller is employed to promote the separation of the labels by pressing the backing against the front side of the peeler, thereby maximizing the angle turned by the label feedstock backing. Separation of the labels is also promoted by employing the tractor-type feed mechanism to pull the stripped continuous backing under tension away from the labeling station.

As it moves toward the labeling station, the opposite edges of the label feedstock backing are engaged by guides which cooperate to direct the feedstock along an appropriate path to the labeling station. These guides are adjustable laterally (or transversely) between the side walls of the apparatus. The labeling apparatus disclosed herein is thereby made capable of accommodating different widths of label feedstocks and, as a consequence, labels of different sizes. The adjustable guides also make it possible to align the labels with different areas of the artifacts being labeled.

As a label is stripped from the continuous backing by the peeler mechanism consisting of the knife-edge peeler and the associated roller, the artifact to which the label is applied is transferred to the labeling station from a loading and unloading station on a rectilinearly displaceable carriage. This carriage travels in a fore-and-aft direction with respect to the longitudinal axis of the apparatus.

An easily replaceable insert so position the artifact on the carriage that the label stripped from the continuous backing will be applied to the wanted part of, and in the proper position on, the artifact being labeled as that artifact arrives at the labeling station. By merely changing the just discussed artifact positioning insert and, in some cases, the stroke of (or distance traveled by) the artifact-supporting carriage, the set-up of my novel labeling apparatus can easily and readily be changed to accommodate a run of artifacts of a different size and/or shape or to simply present the artifacts being labeled in a different orientation or in a different relative location so that a second label can be applied to each of the artifacts.

Adhesion to the artifact being labeled of the label stripped from the continuous backing by the peeler mechanism is promoted by employing the roller of the peeler mechanism, or a second roller, or a brush or other device to press the label against the artifact as the label is stripped from the backing.

Another major component of my novel labeling apparatus is a mechanism which lifts the peeler mechanism upwardly and away from the labeled artifact as the artifact-supporting carriage moves through its return stroke to the station where the artifacts are unloaded from the carriage. This is a significant feature of my invention as it considerably facilitates the removal of the artifact from the labeling apparatus and the loading of an unlabeled artifact onto the carriage.

Those components of my novel labeling apparatus with moving parts are driven by a gear drive. Those components are the label feedstock feed mechanism and a rack-and-pinion drive mechanism for the artifact-supporting carriage. Both the tractor feed drive mechanism and the drive mechanism for the artifact-supporting carriage are operated from a single input gear which may be rotated by a manual crank, by an electric motor, or in any other desired manner. This use of a single drive gear as the input for both the label feedstock feed mechanism and the artifact-supporting carriage is important because it insures that the label to be applied and the artifact to which it is to be applied will arrive at the labeling station where the label is stripped from its backing and applied to the artifact in a precisely timed relationship which results in first the leading edge and then successive portions of the label being applied to the wanted part of the artifact being labeled as the label is separated from its continuous backing rather than the label being applied only after it has been completely detached from its backing. This insures that the label is accurately applied to the artifact and that this accuracy is repeated each time an artifact is transferred to the labeling station for application of a label thereto.

OBJECTS OF THE INVENTION

From the foregoing, it will be apparent to the reader that one important and primary object of the present invention is the provision of novel, improved apparatus for applying labels to artifacts of different shapes and sizes.

Related and also important but more specific objects of my invention reside in the provision of labeling apparatus in accord with the foregoing object:

which is so constructed that a single machine can be used to apply labels to such diverse artifacts as audio and video cassettes, compact and floppy discs, and envelopes and other mailings;

which is simple;

which is easy to set up and to operate;

which is relatively inexpensive to manufacture and maintain;

which is capable of accurately applying a label to a selected part of the artifact being labeled;

which is relatively light and portable;

which is easily adapted for automatic operation;

which is designed to apply labels of different shapes and sizes and to apply labels to artifacts at different locations thereon;

which, in conjunction with the preceding object, includes interchangeable adapters or inserts for supporting the artifacts being labeled in a preselected orientation and position at the station where the labels are applied to those artifacts;

which, in conjunction with the same object, includes mechanism for guiding the labels to the station where they are applied to the artifacts being labeled in a manner that: (1) results in the labels arriving at that station in a preselected timed relationship to the arrival of the artifacts being labeled thereat, and (2) allows the path followed by the labels to be shifted laterally so that labels can be applied to different parts of the artifacts and/or so that labels of different shapes and sizes can be applied to selected parts of the artifacts being labeled;

which, in conjunction with the preceding object, employs a rectilinearily displaceable carriage for the interchangeable adapters and the artifacts carried thereby and a drive mechanism for coordinating the movement of the carriage and the advance of the labels toward the station where the labels are applied to the artifacts;

which is designed to utilize labels adhered at equidistantly spaced intervals to a continuous backing with the backing having marginal perforations that are engageable by the pins of a tractor-type feed mechanism;

which, in conjunction with the preceding object, employs a novel mechanism for bending the continuous backing in a sharp angle to separate the labels therefrom at that location where the labels are applied to the artifacts being labeled;

which, in conjunction with the preceding object, employs peeler mechanism consisting of a peeler with a knifelike leading edge around which the continuous backing is turned to separate the labels from the backing and a roller for pressing the backing against the aforesaid device to promote the separation of the labels from the continuous backing;

which, in conjunction with the preceding object, employs a label drive mechanism that promotes the separation of the labels from the continuous backing by pulling the stripped backing under tension away from the station where the labels are peeled from the backing;

which, in conjunction with the last object but one, employs a roller, brush, or other device for pressing the labels onto the artifacts being labeled as those labels are separated from the continuous backing to which they are adhered; and which, in conjunction with the preceding obJect, employs a novel, automatically operated mechanism for lifting the peeler device away from the artifact after the label has been applied thereto, thereby facilitating the loading and unloading of the artifacts.

Other important objects and features and additional advantages of my invention will be apparent to the reader from the foregoing and the appended claims and as the ensuing detailed description and discussion proceeds in conjunction with the accompanying drawing.

DETAILED DESCRIPTION OF THE INVENTION

Figure 1:
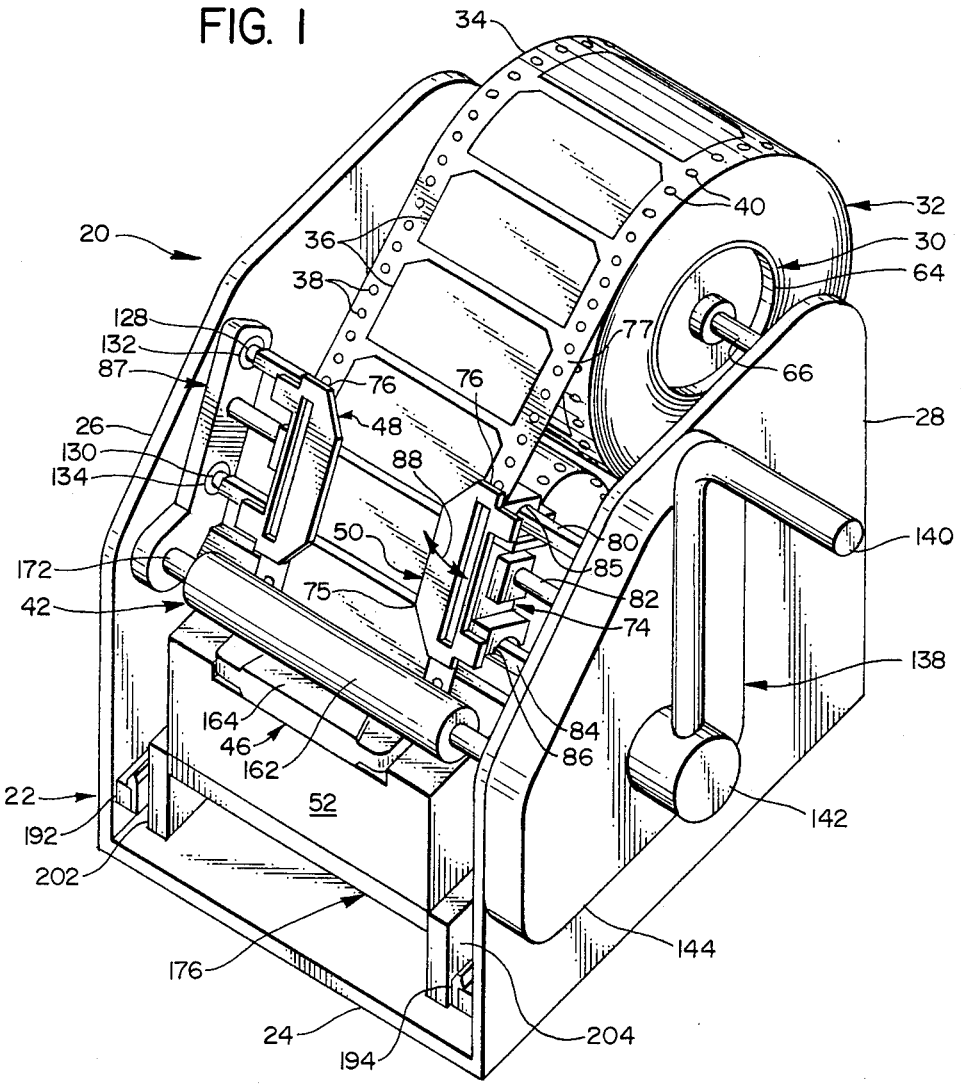
FIG. 1 is a pictorial, generally perspective view of labeling apparatus embodying, and constructed in accord with, the principles of the present invention.

Referring now to the drawing, FIG. 1 depicts a labeling machine or apparatus 20 constructed in accord with, and embodying, the principles of the present invention. Labeling apparatus 20 is designed to apply labels of different shapes and sizes and fabricated of different materials to artifacts which may similarly be of different shapes and sizes and/or positioned in different orientations so that different labels may be applied to various parts of the artifact.

The major components of labeling apparatus 20 include a housing 22. This housing has a horizontally oriented base 24 and vertically extending, parallel, spaced apart side walls 26 and 28 fixed at their lower edges to the opposite edges of the base.

Encased in housing 22 and supported from the side walls 26 and 28 of labeling apparatus housing 22 is a support 30 for the label feedstock. The particular type of feedstock which support 30 is designed to accomodate is the illustrated roll 32 composed of a continuous backing 34 with labels 36 adhesively adhered thereto at regular intervals therealong. The feedstock backing 34 has conventional apertures 38 and 40 formed in the opposite edges thereof for engagement by conventional tractor-type feed mechanisms 41 at opposite sides of the path followed by the label feedstock as it is advanced toward labeling station 42 (only one of the feed mechanisms is shown). There may instead be employed with apparatus 20 a fanfold type label feedstock similarly composed of an apertured continuous backing with adhesively backed labels detactably adhered to that backing at regular intervals therealong.

Another major component of labeling apparatus 20, located at labeling station 42, is a peeler mechanism 44 (see FIG. 2) which is employed to strip the labels 36 from the continuous backing 34 and, as this is done, to press the labels against the artifacts to which they are being applied. This artifact 46 may be an audio cassette as shown in FIG. 1 or virtually any other artifact which it may be desirable to label such as a video cassette. a compact audio disk, a floppy disk, or an envelope or other mailing.

As discussed above, labeling apparatus 20 is designed to be easily and quickly set up so that labels of different shapes and sizes can be applied to the artifacts being labeled and/or to apply labels to different parts of a cassette of given character. This requires that the labeling apparatus be capable of accommodating roll or fanfold type continuous backings of different widths. Such versatility is provided by a pair of feedstock guides 48 and 50 which can be shifted toward and away from the side walls 26 and 28 of housing 22 to accommodate the backings of different widths necessitated by labels of different sizes and/or shapes. These guides can also be relocated to shift the path followed by the label feedstock as it advances toward labeling station 42 toward one side or the other of labeling apparatus 20 so that the labels can be precisely applied to a specified location on the artifact being labeled.

In the illustrated, exemplary embodiment of my invention, the artifacts 46 being labeled are loaded at the front of apparatus 20 on to an artifact-supporting carriage 51. This carriage is displaceable in a rectilinear path from the loading station toward the labeling station 42 where the leading edge of the label 36 stripped from backing 34 by peeler apparatus 44 is pressed against the artifact in an accurate and precisely determined, repeatable position. As the label 36 continues to separate from its backing 34, successive portions of the label are pressed against the label-receiving surface of the artifact, the label thereby becoming attached to the artifact essentially at the same time as it is separated from the backing instead of being completely separated from the backing and then attached to the artifact.

Figure 2:
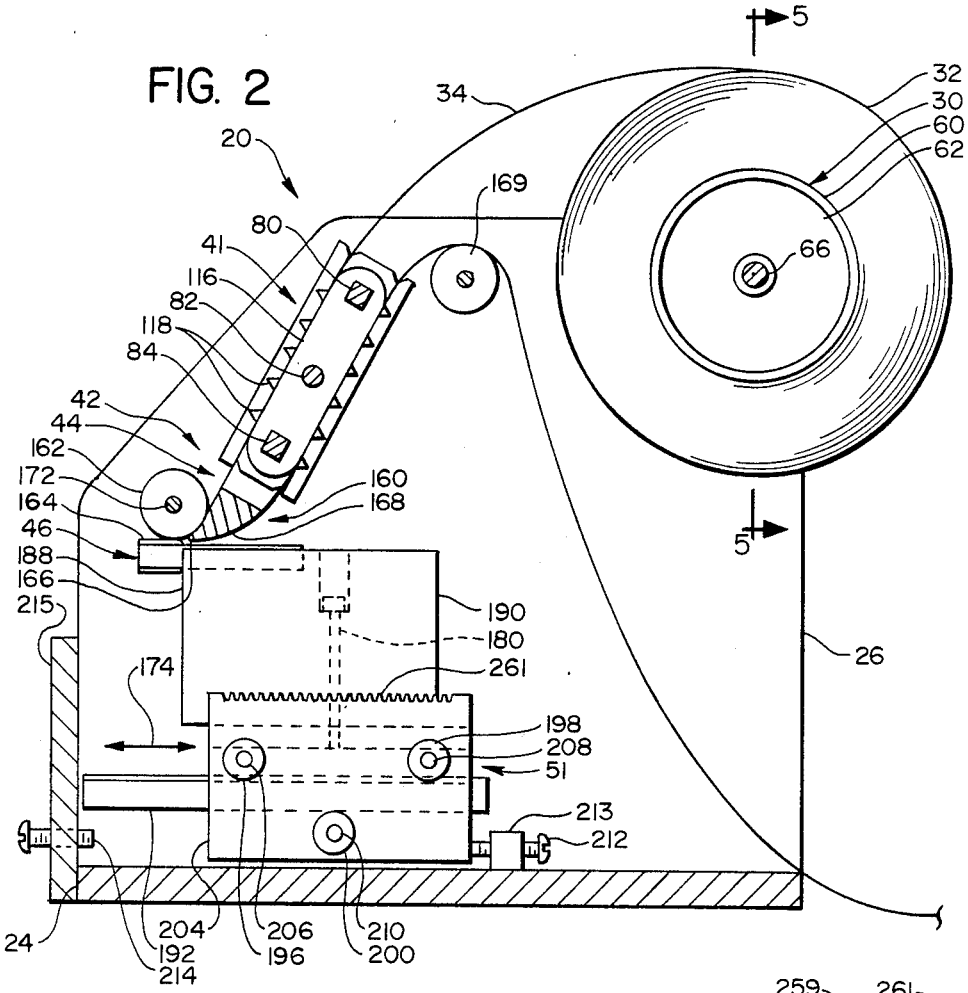
FIG. 2 is a side view of the apparatus with one of two housing side plates removed to show a rectilinearly displaceable carriage on which the artifact being labeled is supported during the labeling cycle, a feed mechanism for the label feedstock, a peeler mechanism for separating the labels from a continuous backing to which they are adhesively attached and for pressing the label against the artifact being labeled as the label is detached from its backing.
Figure 3:
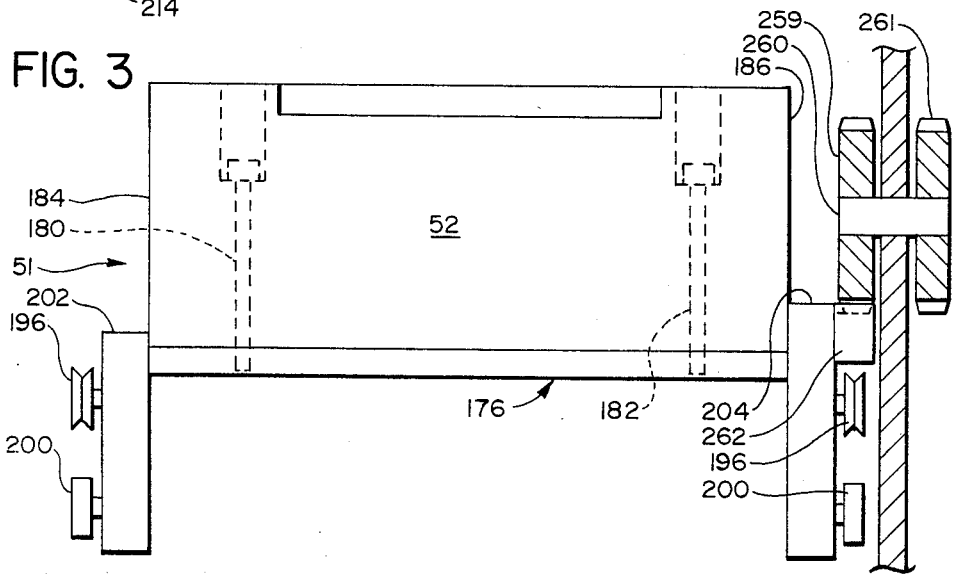
FIG. 3 is a front view of the artifact-supporting carriage, an interchangeable artifact-supporting insert mounted on the carriage, and a roller system for guiding the carriage along tracks fixed to the side walls of the apparatus housing.

Incorporated in carriage 51 are one or more replaceable inserts such as the insert identified by reference character 52 in FIGS. 1–3. Simply by replacing this insert, artifacts of different shapes and sizes can be accommodated by labeling apparatus 20. So can different orientations of the artifact, allowing labels to be applied to different parts of, and different locations on, the artifact being labeled.

Operatively associated with carriage 51 and actuated by the rectilinear displacement of the latter in a forward direction through labeling station 42 for application of a label 36 thereto and then to the afore-mentioned loading station for unloading of the labeled cassette is a crank type, overcenter actuating mechanism 53. During that part of the feed stroke carriage 51 extending from labeling station 42 to the loading station, actuating mechanism 53 lifts peeler mechanism 44 away from the labeled cassette or other artifact 46, facilitating the removal of that artifact from the carriage and the replacement of the labeled artifact with an unlabeled one. During the subsequent, rearwardly directed, reset stroke of carriage 51 to and past labeling station 42, actuating mechanism 53 is returned to an inoperative position, allowing peeling mechansim 44 to return to its operative, labeling stripping and applying position immediately adjacent the artifact 46 being labeled (see FIG. 2).

A final component of labeling apparatus 20 is a gear-type drive mechanism 54 for operating the tractor-type, label feedstock feed mechanisms 41 and a rack-and-pinion drive mechanism 56 which displaces the artifact-supporting carriage 51 through its feed (or forward) and return (or rearward) strokes. Using a single, gear-type drive to operate both the label feed mechanism and the carriage displacing mechanism 56 insures that both the artifact 46 being labeled and the label 36 being applied to the artifact will be so relatively-located as the artifact arrives at labeling station 42 and the label 36 is stripped from its backing 34 that the label will be accurately applied to a precise area of artifact 46. The use of the common, gear-type operating mechansim also guarantees that this accurate result will be consistently obtained.

Figure 5:
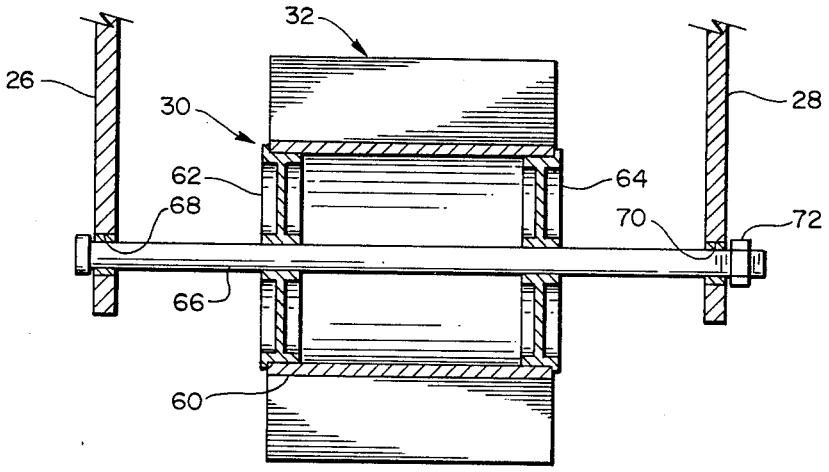
FIG. 5 is an end view of one of two guides employed to direct the continuous backing and the labels carried by the backing along a specified, laterally relocatable path extending from the support for the label feedstock to the label peeling mechanism.

Referring now specifically to FIG. 5, the support 30 for the roll 32 of label feedstock is a spindle which includes a cylindrical sleeve 60 surrounding, and supported frcm, a pair of spaced apart hubs 62 and 64. This assembly of sleeve 60 and hubs 62 and 64 is loosely mounted for sliding movement therealong on a transversely extending, horizontally oriented, spindle supporting shaft or rod 66. Support 66 extends through apertures 68 and 70 in, and is supported from, the side walls 26 and 28 of labeling apparatus housing 22. Shaft 66 is secured in place by a nut 72.

The arrangement just described allows the label feedstock support 30 to shift back and forth along shaft 66. As a consequence, the roll 32 of label feedstock can follow the path determined by feedstock guides 48 and 50 as the feedstock is advanced toward labeling station 42 by tractor feed mechanisms 41 even though those guides are relocated to accommodate a feedstock of different width or to shift the location at which the labels are applied to the artifacts being labeled.

Figure 4:
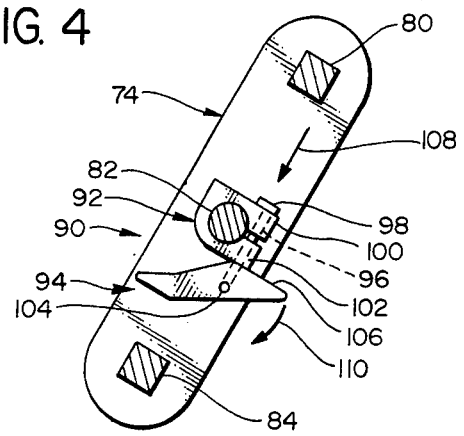
FIG. 4 is a front view of an arrangement employed in the apparatus of FIG. 1 to support a roll of a label feedstock which consists of a continuous backing bearing detachable, adhesively backed labels which are to be applied to the artifacts being labeled.

Referring now to FIGS. 1 and 4, each of the two feedstock guides 48 and 50 includes a monolithic base 74 and a guide component 75 formed from sheetlike material. Guide component 75 is fixed to base 74 with a gap 76 therebetween. Gap 76 is dimensioned to receive an edge of label feedstock backing 34 such as that identified by reference character 77 in FIG. 1. Guide component 75 traps the edge 77 of the label feedstock backing against the base 74 of the guide with the edge 77 of the backing engaging the guide at the inner end of gap 76. This positions the backing 34 laterally with respect to the side walls 26 and 28 of labeling apparatus housing 22, confining the label feedstock to an appropriate path as it is advanced toward labeling station 42 by feed mechanisms 41.

The two label feedstock guides 48 and 50 are supported from and/or oriented by three, laterally extending, shaft-like components 80, 82, and 84. Circularly sectioned openings 85 through, and slots 86 in, the base 74 of the guide allow transversely oriented shafts 80 and 84 to maintain feedstock guides 48 and 50 at an appropriate inclination as shown in FIG. 1. At the same time, these circular configurations of opening 85 and slot 86 leave shafts 80 and 84 free to rotate about their longitudinal axes which is necessary as will become apparent below.

Shaft 80 extends between, and is rotatably supported in any convenient fashion from, the side walls 26 and 28 of labeling apparatus housing 22. The other two feedstock guide supporting shafts 82 and 84 also extend transversely of labeling apparatus 20, and they are oriented parallel to shaft 80. The ends of shaft 82 are fixed to two depending arms which are pivotally supported for rotation about a common, horizontal, transversely extending axis by the side wall supported shaft 80. Shaft 84 is rotatably supported between and from those arms.

Figure 6:
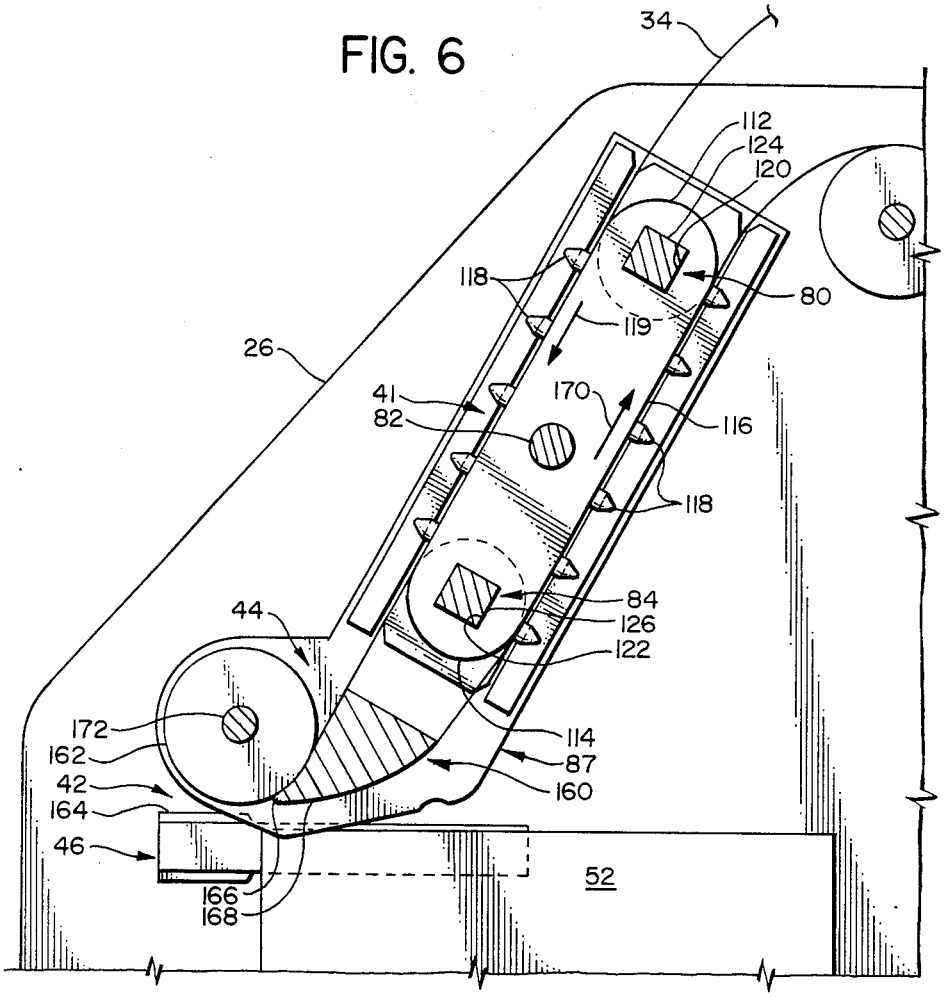
FIG. 6 is a side view of the peeler and label applying mechanism and of one of two tractor-type, pin-feed mechanisms employed to advance the label-bearing continuous backing toward the peeler mechanism and to promote the peeling of the labels from the backing by pulling the backing from which the labels have been peeled under tension away from the peeling mechanism.
Figures 7, 7A:
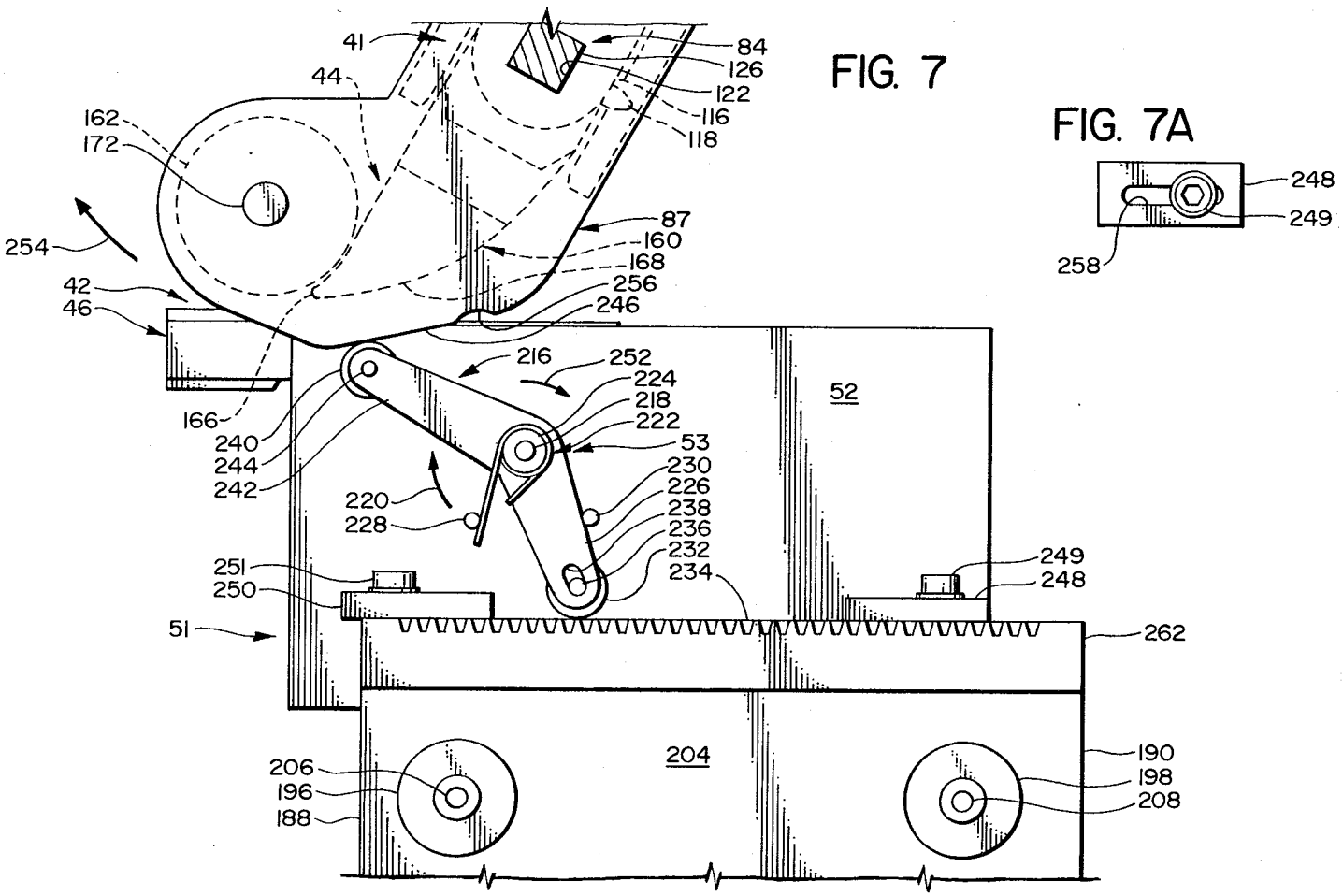
FIG. 7 is a view of an operating mechanism provided to lift the label peeling and label applying mechanism away from the artifact being labeled at the end of the labeling cycle to facilitate the loading and unloading of the artifacts being labeled from the carriage on which they are supported during the labeling cycle.
FIG. 7A is a plan view of a carriage-mounted actuator for the operating mechanism illustrated in FIG. 7.

These pivotally supported arms carry the tractor feed mechanisms 41 for the label feedstock (see FIG. 6) and the peeler mechanism 44 by which labels 36 are stripped from backing 34 and applied to the artifact 46 being labeled at labeling station 42. One of these pivotable, depending arms, which are identical, is shown in FIGS. 1, 6, and 7 and identified by reference character 87.

As indicated by the double-headed arrow 88 in FIG. 1, and as was mentioned briefly above, each of the two feedstock guides 48 and 50 can be shifted along supporting shafts 80, 82, and 84. This so positions the label feedstock transversely of the labeling apparatus as it is advanced toward labeling station 42 that the labels will be applied at the proper locations to the artifacts 46 being labeled as the labels are peeled from the continuous backing 34. Each of the two feedstock guides is locked in the appropriate position dictated by the lateral dimension of the label being applied and the lateral location at which the label is to be applied to the artifact 46 being labeled by a locking mechanism illustrated in FIG. 4 and identified by reference character 90.

Turning now to FIG. 4, each of the two identical locking mechanisms 90 includes: a split retainer 92 which surrounds the elongated guide or shaft 82 on which the associated guide 48 or 50 and is slidingly supported and fixed to the monolithic base 74 of that associated feedstock guide; an overcenter type latch 94; and a pin 96 which has a head 98 abutting and engageable with one of the two relatively displaceable jaws 100 and 102 of retainer 92. At its end opposite head 98, pin 96 is fixed to overcenter latch 94 as by a pin 104. That pin also pivotally secures latch 94 to the monolithic base 74 of the associated feedstock guide 48 or 50.

With latch 94 in the position shown in FIG. 4, external cam surface 106 is engaged with the jaw 102 of split retainer 92, pulling pin 96 in the direction indicate by arrow 108 in FIG. 4. This clamps the two jaws 100 and 102 of the split retainer together, frictionally locking the retainer to guide 82. That keeps the feedstock guide 48 or 50 in which the locking mechanism is incorporated in a fixed position relative to the side walls 26 and 28 of labeling apparatus housing 22.

Rotation of overcenter latch 94 in a clockwise direction as indicated by arrow 110 in FIG. 4, in contrast, allows split retainer jaws 100 and 102 to spring apart, freeing the retainer and the feedstock guide in which it is incorporated for movement along the shaft 82 supporting the guide.

As mentioned above, the pivotally mounted, depending arms 87 from which the just-discussed feedstock guides 48 and 50 are in part supported also supports the tractor feed mechanisms 41 by which the label feedstock is displaced from roll 32 or a fanfold of label feedstock (not shown) to labeling station 42.

There are two tractor feed mechanisms 41 as was mentioned briefly above. These respectively cooperate with the pin feed apertures 38 and 40 in the opposite edges of label feedstock backing 34 to insure that the feedstock is propelled along a straight, unskewed, rectilinear path toward labeling station 42. Because the two tractor feed mechanisms are identical, only the one identified by reference character 41 in the drawing will be described herein. Furthermore, because this feed mechanism is of a conventional, commercially available construction, it will not be described in any particular detail herein.

Referring now in particular to FIG. 6, the label feedstock tractor feed mechanism 41 shown in that figure includes upper and lower rolls 112 and 114 with a flexible, endless belt 116 trained therearound. Carried by, and protruding outwardly from, endless belt 116 are pins 118. These pins are so spaced along belt 116 that they engage successive apertures 38 (or 40) in the continuous backing 34 of the label feedstock. Therefore, by driving belt 116 in the direction indicated by arrow 119, the label feedstock backing 34 and the labels 36 spaced along that backing can be advanced from feedstock support 30 or a fanfold toward labeling station 42.

The belt-supporting rolls 112 and 114 of each tractor feed mechanism 41 have square central bores 120 and 122 through which complementary, square sectioned portions 124 and 126 of the two, transversely extending, rotatable shafts 80 and 84 extend. This arrangement locks rolls 112 and 114 to shafts 80 and 84 for rotation therewith.

As mentioned above, these two shafts 80 and 84 extend between the two pivotable, depending arms 87 from which the label feedstock feed mechanisms 41 and peeler mechanism 44 are supported. And, as is shown in FIG. 1, the end portions 128 and 130 of those shafts have a circular section and are rotatably journaled in bearings 132 and 134 fitted in each of the two arms 87.

The shaft 80 supporting the two upper rolls 112 of the two tractor-type feed mechanisms 41 are rotated in a counterclockwise direction to displace the endless belts 116 of the two mechanisms in the direction shown by the above-discussed arrow 119 in FIG. 6. This advances the label feedstock toward labeling station 42 by the drive mechanism 54 mentioned briefly above and shown in detail in FIGS. 1 and 8.

Turning now to those figures, drive mechanism 54 includes, inter alia, a hand-operated crank 138 with a horizontally extending handle 140 at its outer end; a crankshaft 142 to which the inner end of crank 138 is attached; a gear train cover 144 fixed in any convenient fashion to the vertical side wall 28 of labeling apparatus housing 22; an input gear 146 fixed for rotation therewith to the inner end of crankshaft 142; an idler or transfer gear 148 meshed with input gear 146 and rotatably supported from crankshaft support 144 on a shaft 150; and an output or driven gear 152, all housed between housing side wall 28 and cover 144.

Figure 8:
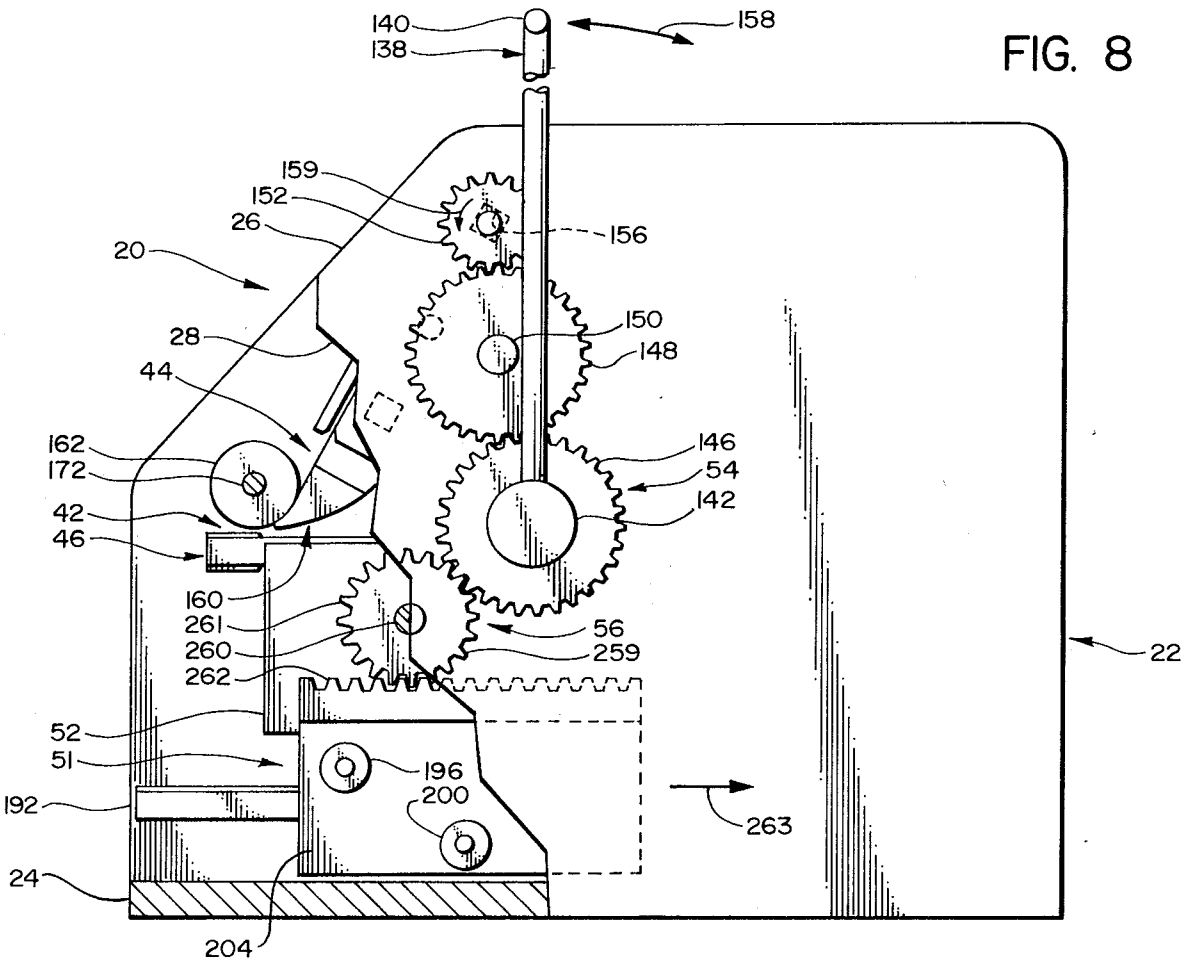
FIG. 8 is a view similar to FIG. 2 but showing the details of a drive train provided in the apparatus of FIG. 1 to coordinate the movement of the artifact-supporting carriage toward and away from the labeling station where the labels are peeled from their backing and simultaneously applied to the artifacts being labeled in timed relation to the advance of the labels to the labeling station.

As is best shown in FIG. 8, driven gear 152 surrounds the central section 124 of the shaft 80 to which the drive roll 112 supporting feed mechanism belt 116 is coupled. A conventional one-way clutch 156 of the wedge-and-roller type is fitted in the hub of feed mechanism output gear 152 with its input and output members (not shown) respectively coupled to output gear 152 and shaft 80 for rotation therewith.

Rotation of crank 138 in the counterclockwise direction indicated by arrow 158 in FIG. 8 to advance carriage 51 through its feed stroke engages clutch 156 as indicated by arrow 159 and effects: a rotation of input gear 146 in the same direction, a clockwise rotation of idler or transfer gear 148, a counterclockwise rotation of output gear 152, and the advance of tractor feed mechanism endless belt 116 from label feedstock support 30 toward labeling station 42 as indicated by arrow 119 in FIG. 6.

Clutch 156 disengages when crank 138 is rotated in a clockwise direction as shown in FIG. 8 after a label 36 has been applied and the labeled artifact 46 has been removed to displace carriage 51 toward the rear of apparatus 20 and return peeler mechanism 44 to its operative position. Movement of the label feedstock is obviously not wanted during this reset stroke of the carriage and is prevented by the just-discussed disengagement of the one-way clutch.

Referring now to FIGS. 1, 2, and 6–8, it was pointed out above that the label feedstock consisting of continuous backing 34 with adhesively backed labels 36 spaced at specified intervals therealong is advanced by the tractor feed mechanisms 41 just discussed from feedstock support 30 through feedstock guides 48 and 50 to the peeler mechanism 44 at labeling station 42. Here, the labels 36 are separated from the continuous backing 34 by a peeler 160 and a transversely extending roll or roller 162 and pressed against the upper surface 164 of the artifact 46 being labeled by the same roll 162.

Peeler 160 is a barlike component. It extends horizontally across apparatus 20 at labeling station 42. Its opposite ends are fixed, in any convenient manner, to the depending, pivotally mounted supports 87 between which feedstock drive mechanisms 41 and feedstock guides 48 and 50 are mounted.

Peeler 160 has a small radius, knifelike, leading edge 166 around which the continuous backing 34 of the label feedstock material is trained. To insure that the continuous backing closely follows knife edge 166 and the curved, lower, back side 168 of the peeler, the sprocket holes 38 and 40 in the opposite edges of continuous backing 34 are caused by a transversely extending, horizontal roller 169 to be engaged by the projecting pins 118 on tractor feed mechanism endless belts 116 as these belts move through the return path indicated by arrow 170 in FIG. 6. This keeps continuous backing 34 taut and under tension, maximizing the angle through which the continuous backing is bent. This promotes the separation of the continuous backing 34 and the label 36 being applied because the label is caused by the artifact to which it is being applied to follow a generally horizontal path along the lower side of roller 162 as that label is applied to the upper surface 164 of the artifact, and the backing is bent through an angle approaching 180° from that path as the label separates from it.

As mentioned above, the just-described roller 162 is also relied upon to press the separating label 36 against the upper surface 164 of the artifact being labeled. That roller extends transversely across labeling apparatus 20. It is supported from the lower ends of pivotable supports 87 for rotation about a horizontal, transverse axis on a shaft 172. With the peeler mechanism 44 in the operative position shown in FIGS. 1, 2, 6, and 7, the lower part of the peripheral surface of roller 162 is in contact with, and presses the separating label 36 against, the upper, label receiving surface 164 of the artifact 46 being labeled.

The artifact 46 being labeled is so displaced by carriage 51 through the forward or feed stroke toward the front of labeling apparatus 20 through labeling station 42 as indicated by arrow 174 so that the label 36 being applied will flow smoothly onto label receiving surface 164 of the artifact. As discussed above, carriage 51 also displaces the labeled artifacts 46 in the remaining part of this feed stroke to the loading station for removal from the labeling apparatus. And, in an oppositely directed return stroke, the carriage displaces as yet unlabeled artifacts through a return stroke toward the rear of the labeling apparatus, restoring peeler mechanism 44 to an operative position and so positioning the unlabeled artifact that a label can be applied to it as the carriage moves through a subsequent feed stroke.

As is best shown in FIGS. 1, 2, and 8, carriage 51 includes a platform 176. The insert 52 configured as discussed above to support an artifact 46 in a specified location and in a particular orientation when the artifact reaches labeling station 42 is attached as by headed, threaded fasteners 180 and 182 (see FIG. 3) to platform 176. These fasteners are located toward the sides 184 and 186 of insert 52. They are threaded into the platform between the front 188 and back 190 of carriage platform 176.

By simply removing fasteners 180 and 182, replacing the insert, and reinstalling the fasteners, labeling apparatus 20 can easily and quickly be set up to accommodate artifacts 46 of different shapes and sizes or to accommodate the same artifact in different orientations so that more than one label 36 may be applied to it. Thus, it is economically feasible to set labeling apparatus 20 up for runs of short duration as well as those of longer character.

Referring still to FIGS. 1, 2, and 6–8, the artifact-supporting carriage 51 is supported for rectilinear movement along the path 174 identified in FIG. 2 by two horizontal, longitudinally extending rails 192 and 194. These rails are fixed in any convenient fashion to the side walls 26 and 28 of labeling apparatus housing 22 toward the base 24 of that housing.

Cooperating with rails 192 and 194 to guide carriage 51 therealong are, on each side of the carriage, two upper wheels 196 and 198 and a lower wheel 200. The two upper wheels 196 and 198 have V-grooved peripheries which complement the configurations of the upper edges of guide rails 192 and 194. This arrangement spaces carriage 51 laterally between the side walls 26 and 28 of labeling apparatus 20 and causes the carriage to move in a straight path along rails 192 and 194.

Upper wheels 196 and 198 are rotatably supported from the depending side wall 202 (or 204) of carriage platform 176 as by shafts or axle 206 and 208. These shafts are located respectively near the front and rear ends 188 and 190 of the carriage.

Lower wheel 200, which has a flat periphery corresponding to that of the associated lower rail edge, is rotatably supported from carriage platform side member 202 (or 204) by axle or shaft 210. As is best shown in FIG. 2, the rails 192 and 194 are thereby trapped between the associated upper carriage wheels 196 and 198 and the lower carriage wheel 200 to confine carriage 51 to the wanted horizontal, rectilinear path 174.

Referring still to FIG. 2, the rearward travel of carriage 51 is limited by a horizontally oriented stop 212. The stop is threaded through a bracket 213 which is fixed to the base 24 of apparatus housing 22 and is so positioned above that base as to engage the platform 176 of artifact-supporting carriage 51.

A second, similar, adjustable stop arrangement is employed to limit the forward travel of carriage 51 when the latter reaches the location at which artifacts are conveniently loaded onto and removed from that carriage. That stop arrangement consists of a stop 214 threaded through a plate 215 spanning and fixed to housing side walls 202 and 204. Stop 214 insures that the carriage will not run off tracks 192 and 194.

Also, stops 212 and 214 are adjusted so that the stroke of carriage 51—i.e., the distance it travels between its rearward limit of travel and the station where artifacts are unloaded—is matched to the advance of the label feedstock during each operating cycle of apparatus 20. This is necessary because: (1) if the stroke is too short, the label 36 will not be completely separated from backing 34 and adhered to the artifact when carriage 51 reaches the end of its feed stroke, and (2) if the advance of the label feedstock is too long relative to the stroke of the carriage, a second label will begin to have been peeled from the continuous backing by the time the carriage reaches the end of its feed stroke. Both of these problems are avoided by adjusting stops 212 and 214 so that carriage 51 will reach the end of its feed stroke after the label 36 being applied has been completely separated from its continuous backing 34 and adhered to the artifact 46 being labeled but before a subsequent label 36 starts to separate from the backing.

Referring now to FIG. 7, carriage 51 is also employed to operate crank-type actuating mechanism 53. As discussed above, that mechanism is activated as carriage 51 nears the end of its return stroke. It lifts tractor feed mechanisms 41 and peeler mechanism 44 away from the now labeled artifact 46 on the carriage, facilitating the removal of that artifact from the carriage and the replacement of the labeled artifact with an unlabeled one.

Referring still to FIG. 7, actuating mechanism 53 includes a double-armed crank 216 supported for rotation about a horizontal axis from the side wall 26 of labeling apparatus housing 22 by pivot member 218. Crank 216 is biased in a counterclockwise direction (see arrow 220 in FIG. 7) by a coil spring 222. This spring moves actuating mechanism 53 out of the way so that the label applying roll 162 of peeler mechanism 44 can press the detaching label 36 against the upper, label receiving surface 164 of the artifact 46 being labeled.

Spring 222 is trained around a sleeve 224 journaled on crank supporting pivot pin 218. One end of spring 222 is engaged with the forward edge of lower crank arm 226. The other end of the spring is trapped against a stop 228 fixed to labeling apparatus housing side wall 26.

A second stop 230 is likewise fixed to carriage housing side wall 26. This stop insures that the counterclockwise rotation imparted to crank 216 by spring 222 is so limited as to cause a roller 232 at the outer end of lower arm 226 to remain engaged at all times with the upper surface 234 of carriage platform side wall 202.

The just alluded to roller 232 is fixed to the outer end of lower crank arm 226 by a roller supporting shaft 236. That shaft extends through an elongated slot 238 in the crank arm so that roller 232 can move up and down as carriage 51 moves forward and rearward and the distance between the outer end of the lower crank arm and the upper surface 234 of carriage platform side wall 202 therefore respectively decreases and increases. This allows roller 232 to remain in contact with upper side wall surface 234 throughout the travel of carriage 51 without stressing the crank, roller supporting shaft, or crank supporting pin 218. A second roller 240 is rotatably supported from the outer end of upper crank arm 242 by shaft 244. As is apparent from FIG. 7, roller 240 is so dimensioned and located as to engage the lower side 246 of the pivotably mounted, feedstock guide and peeler mechanism supporting arm or bracket 87 beneath which the crank is directly located.

As carriage 51 moves through its feed stroke toward the front of labeling apparatus 20, an actuator 248 secured as by fastener 249 to the upper surface 234 of carriage platform side wall 202 engages lower crank roller 232. This causes crank 216 to rotate in the clockwise direction indicated by arrow 252 in FIG. 7. As crank 216 rotates in this direction, upper roller 240 rolls along the lower edge 246 of support arm 87. This rotates peeler and feed mechanism support arms 87 in a clockwise direction. That raises peeler mechanism 44 upwardly and away from the labeled artifact 46 to facilitate the removal of that artifact from carriage 51 as indicated by arrow 254 in FIG. 7.

The support arms 87 and peeler mechanism 44 continue to rise until the upper roller 240 of crank mechanism 53 rides into a detent 256 which is formed in the lower edge 246 of the pivotable support 87 above the crank. This retains peeler mechanism 44 in an elevated position, facilitating the removal of the labeled artifact 46 from carriage 51 and its replacement with an unlabeled artifact.

The peeler mechanism remains in this elevated position until crank 138 is again rotated in the counterclockwise direction to start carriage 51 on its rearwardly directed, reset stroke. As the carriage proceeds through this stroke, the movement of the carriage is utilized to rotate crank 216 in a counterclockwise direction through an over- center position. As carriage 51 then continues to move toward the rear of labeling apparatus 20, the weight of the pivotable support arms 87, peeler mechanism 44, and tractor feed mechanisms 41 combine to further displace crank 216 in the counterclockwise direction indicated by arrow 220. This allows peeler mechanism 44 to move downwardly until peeler 160 and roller 162 are once again positioned in operative relationship to the upper surface 164 of an artifact 46 to which a label 36 is to be applied. A second actuator 250 fixed to the upper surface 234 of carriage platform side wall 202 engages the roller 232 at the outer end of lower crank arm 226. This displaces crank 216 in a counterclockwise direction indicated by arrow 220 in FIG. 7, moving the roller 240 at the outer end of upper crank arm 242 out of detent 256 and displacing the crank over center.

An elongated slot 258 is formed in actuator 248 (see FIG. 7A), and a similar slot (not shown) is formed in actuator 250. These slots allow actuators 248 and 250 to be so adjusted along carriage platform side wall 202 that: (1) roller 232 will be engaged by actuator 248 as carriage 51 nears the end of its feed stroke, and after a label 36 has been completely attached to the artifact being labeled so that the peeler mechanism will remain in its operative position until the labeling is completed but then be lifted away from the artifact as the end of the feed stroke is reached to facilitate removal and replacement of the artifact, and (2) roller 232 will be engaged by actuator 250 to initiate the resetting of the peeler mechanism to its operating position just before carriage 51 reaches the limit of its rearwardly directed, reset stroke determined by stop 212.

Carriage 51 is displaced through the feed and reset strokes discussed above in timed relation to the advance of the label feedstock from roll 32 to labeling station 42 by the drive mechanism 54 discussed above and illustrated in FIG. 8. In addition to the drive components discussed above in conjunction with the tractor feed mechanisms 41 for the label feedstock, drive mechanism 54 includes the previously mentioned rack-and-pinion type mechanism 56 which is utilized to displace carriage 51 through its forward and reset strokes as crank 138 is rotated first in a counterclockwise and then in a clockwise direction. Rack-and-pinion mechanism 56 includes a pinion 259 meshed with the input gear 146 of drive mechanism 54. Pinion 259 is rotatably supported from the apparatus housing side wall 28 of labeling apparatus 20 by a shaft 260 which extends through side wall 28. A second pinion 261 is fixed to shaft 260 for rotation therewith on the inner side of side wall 28 above, and in mesh with, rack 262. The rack 262 with which it meshes is fastened to, and extends along, carriage platform side wall 204.

The counterclockwise rotation of crank 138 indicated by arrow 158 in FIG. 8 and effected to advance the continuous label feedstock backing 34 and the labels 36 carried thereby toward labeling station 42 also effects a counterclockwise rotation of pinion 260. That movement in turn produces a concomitant rectilinear movement of rack 262 and the carriage 51 in which it is incorporated through the forwardly directed, label applying feed stroke indicated by arrow 263 in FIG. 8.

Figure 9:
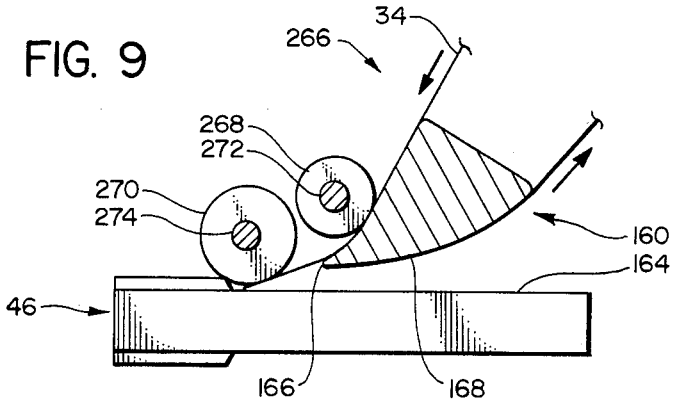
FIGS. 9 and 10 are partial side views of the peeler mechanism, the artifact being labeled, and two alternate arrangements employed in the peeler mechanism for pressing a label against the artifact as the label is detached from the continuous backing of the label feedstock.

In the embodiment of my invention described above, a single roller 162 is employed for dual purposes; viz.: (1) to promote the separation of the labels 36 from the continuous backing 34 of the label feedstock by helping to insure that the backing closely follows the contour of peeler 160 as it moves around the lower end and the knife edge 166 of that bar, and (2) to press the separating label 36 against the upper surface 164 of the artifact 46 being labeled. In other applications of the principles disclosed herein, it may be deemed preferable to separate these two functions of roller 162. This has been done in the peeler mechanism 266 illustrated in FIG. 9.

In peeler mechanism 266, the first of the aforementioned functions is accomplished by a roller 268 and the second, pressing-on function by a separate, second roller 270. Rollers 268 and 270 are supported in horizontal, parallel, spaced apart relationship from the peeler mechanism supporting guides 87 by shafts 272 and 274 which are rotatably journaled in those arms.

Figure 10:
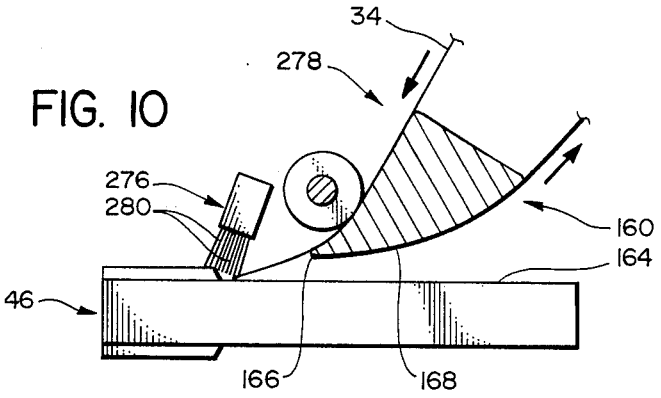

It is likewise not necessary that a roller be employed to press the labels 36 onto the artifacts 46 being labeled as the labels are separated from their continuous carrier 34. As shown in FIG. 10, a brush (identified by reference character 276) can instead be employed for that purpose in the peeler mechanism 278 illustrated in FIG. 10. To promote the adherence of the label 36 to the upper surface 164 of the artifact 46 being labeled, brush 276 will typically be tilted so that its bristles 280 are inclined toward the front of the labeling apparatus as is shown in FIG. 10. Like the rollers discussed above, brush 276 extends horizontally between, and is fixed to, the pivotable brackets 87 from which the peeler mechanism 278 is supported.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent of the United States is:

1. Apparatus for applying a label to each of a succession of artifacts at a like location on each said artifact, said apparatus comprising: a base; a carriage moveable along said base from an initial position in a first direction and in a direction opposite to said first direction, said carriage including means for supporting the artifacts to be labeled; means for supplying a label feedstock comprising a continuous backing with the labels to be applied to said artifacts removably adhered to said backing at predetermined intervals therealong; means for peeling the labels seriatim from said backing; means for so displacing said backing and the labels carried by said backing as to advance successive ones of the labels carried by said backing means to said peeling means; a mechanical movement for advancing said carriage and the artifact being labeled and supported by said carriage in said first direction to a labeling station in the vicinity of said peeling means as the label being applied is peeled from the backing; and means for pressing said label onto said artifact at the desired location as the label is peeled from the backing and before it is completely separated therefrom; said mechanical movement subsequently being operable in said first direction to displace the labeled artifact to a location removed from the peeling means where the labeled artifact can be removed from the labeling apparatus, said mechanical movement also including the means for advancing the label feedstock continuous backing and the labels carried thereby to said peeling means, and said label feedstock advancing means comprising means which renders it ineffective to affect any movement of said labels and said backing while the artifact-bearing carriage is moving in the direction opposite to the aforesaid first direction and for thereafter displacing the carriage in said opposite direction to the at rest position.

2. Labeling apparatus as defined in claim 1 wherein the means for rendering the label and backing advancing means ineffective while the artifact-supporting carriage is moving in said opposite direction comprises a one-way clutch.

3. Apparatus for applying a label to each of a succession of artifacts at a like location on each said artifact, said apparatus comprising: a base; a carriage moveable along said base, said carriage including means for supporting the artifacts to be labeled; means for supplying a label feedstock comprising a continuous backing with the labels to be applied to said artifacts removably adhered to said backing to predetermined intervals therealong; means for peeling the labels seriatim from said backing; means for so displacing said backing and the labels carried by said backing as to advance successive ones of the labels carried by said backing to said peeling means; means for advancing said carriage and the artifact being labeled and supported by said carriage to a labeling station in the vicinity of said peeling means as the label being applied is peeled from the backing, said last-mentioned means including means for guiding said carriage in a rectilinear path along said base and means for displacing said carriage in opposite directions along said path, said carriage displacing means comprising a rack incorporated in said carriage and extending in the direction of said rectilinear path, a gear rotatably supported relative to the base of the labeling apparatus and meshing with said rack, and means for rotating said gear; and means for pressing said label onto said artifact at the desired location as the label is peeled from the backing and before it is completely separated therefrom.

4. Labeling apparatus as defined in claim 3 wherein said carriage comprises a horizontal platform and vertically oriented side members on opposite sides of said platform and wherein the means for guiding the carriage in the rectilinear path along the base includes, on each side of said carriage and rotatably supported from the carriage side member thereat, first and second wheels respectively located toward the front and rear of the carriage and engageable with the upper edge of the track at that side of the carriage and a third lower wheel located intermediate the front and rear ends of the carriage and rollable along the lower edge of the aforesaid track.

5. Labeling apparatus as defined in claim 4 wherein the peripheries of said first and second wheels and the upper edge of said track have complementary grooves and recesses which cooperate to position said carriage laterally relative to said base and which also cooperate to confine said carriage to said rectilinear path as the carriage moves along said path.

6. Labeling apparatus as defined in claim 3 wherein the means for rotating the gear engaged with the rack includes a main drive gear and wherein the means for advancing the label feedstock backing and the labels carried thereby toward the means provided for peeling said labels from said backing comprises, at each side of the path followed by the label feedstock and pin means projecting outwardly from said belt at equidistantly spaced intervals therealong, said pin means being so spaced as to engage equally equidistantly spaced apertures in the edges of the backing and thereby make said endless member capable of positively advancing said backing and the labels carried thereby along said path and said label feedstock advancing means further comprising a driven roller around which one end of each belt is trained, a second roller around which the opposite end of each said belt is trained, and means for rotating the driven roller which comprises a driven gear rotatable with the driven roller and an intermediate gear meshed with said driven gear and with said main drive gear.

7. Labeling apparatus as defined in claim 6 wherein the driven gear rotatable with the endless belt driving roller includes a one-way clutch for disengaging said driving roller from said intermediate gear and thereby keeping said endless belt from displacing said label feedstock backing and the labels carried thereby toward said label peeling means when said artifact-supporting carriage is being displaced in a direction away from said peeling means toward a location remote frcm said peeling means where said artifact can be easily removed from said carriage.

8. Labeling apparatus as defined in claim 6 which has side walls extending vertically from said base at opposite sides thereof and a crank for rotating said main drive gear, said crank being rotatably supported from one of said side walls.

9. Apparatus for applying a label to each of a succession of artifacts at a like location on each said artifact, said apparatus comprising: a base; a carriage moveable along said base, said carriage including means for supporting the artifacts to be labeled; means for supplying a label feedstock comprising a continuous backing with the labels to be applied to said artifacts removably adhered to said backing at predetermined intervals therealong; means for peeling the labels seriatim from said backing; means for so displacing said backing and the labels carried by said backing as to advance successive ones of the labels carried by said backing to said peeling means; means for advancing said carriage and the artifact being labeled and supported by said carriage to a labeling station in the vicinity of said peeling means as the label being applied is peeled from the backing; and means for pressing said label onto said artifact at the desired location as the label is peeled from the backing and before it is completely separated therefrom; a pair of vertically oriented support arms, means so pivotally supporting one of said arms at the upper end thereof from a side wall such that said arms are rotatable about a common, horizontal, transversely extending axis, and means supporting said peeling means and the means for advancing the label feedstock toward the peeling means from and between said support arms; and means effective as said carriage is displaced from said labeling station toward a first location where artifacts can be conveniently removed from and loaded onto said carriage for rotating said pivotally mounted support arms upwardly about said common pivot axis to thereby displace said label peeling means upwardly and away from said carriage to thereby facilitate the removal of artifacts from the carriage and the loading of artifacts onto the carriage; the means for displacing said label peeling means as aforesaid comprising crank means; means rotatably supporting said crank means from one of said side walls beneath, and in alignment with, the support arm pivotally supported from the same side wall; and means so engageable with said crank means as said carriage is displaced toward said first location as to rotate the crank means about its pivot axis past an overcenter position in a manner which causes said crank means to rotate said pivot arms in the manner as aforesaid which raises said label peeling means away from said carriage to facilitate the loading of artifacts onto the carriage and the removal of artifacts therefrom.

10. Labeling apparatus as defined in claim 9 wherein the means engageable with said crank means to rotate it as aforesaid is a stop fixed to that side wall of said carriage which is on the same side of said labeling apparatus as the crank means.

11. Labeling apparatus as defined in claim 9 wherein said crank means comprises a crank with an upper arm and a follower rotatably supported from the outer end of said arm and wherein there is a detent in the support arm above said crank arm into which said follower can ride to retain said support arms and the label peeling means carried thereby in a position to which they are elevated by the aforesaid rotation of said crank means.

12. Labeling apparatus as defined in claim 11 which comprises means displaceable with said carriage and operable as the carriage is moved from said first location through said labeling station and toward a second location for rotating said follower out of said detent and past said overcenter position, thereby allowing said support arms to rotate downwardly and lower said label peeling mechanism into an operative position relative to an artifact which is to be labeled.

* * * * *